US011408435B2

(12) United States Patent
Iwakiri et al.

(10) Patent No.: US 11,408,435 B2
(45) Date of Patent: Aug. 9, 2022

(54) ROTOR AND CENTRIFUGAL COMPRESSOR INCLUDING THE SAME

(71) Applicant: MITSUBISHI HEAVY INDUSTRIES ENGINE & TURBOCHARGER, LTD., Sagamihara (JP)

(72) Inventors: Kenichiro Iwakiri, Tokyo (JP); Nobuhito Oka, Sagamihara (JP); Hironori Honda, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 17/040,137

(22) PCT Filed: Jun. 22, 2018

(86) PCT No.: PCT/JP2018/023830
§ 371 (c)(1),
(2) Date: Sep. 22, 2020

(87) PCT Pub. No.: WO2019/244344
PCT Pub. Date: Dec. 26, 2019

(65) Prior Publication Data

US 2021/0018014 A1 Jan. 21, 2021

(51) Int. Cl.
*F04D 29/30* (2006.01)
*F04D 29/28* (2006.01)
(Continued)

(52) U.S. Cl.
CPC ..... *F04D 29/284* (2013.01); *F04D 17/10* (2013.01); *F04D 29/30* (2013.01); *F04D 29/384* (2013.01);
(Continued)

(58) Field of Classification Search
CPC ..... F04D 29/284; F04D 29/30; F04D 29/384; F04D 29/386; F04D 17/10;
(Continued)

(56) References Cited

U.S. PATENT DOCUMENTS 3,027,845 A * 4/1962 Gilman ..... F04D 29/688 415/204
3,068,801 A * 12/1962 Murray ..... F04D 29/146 415/109
(Continued)

FOREIGN PATENT DOCUMENTS

CN 1299003 A 6/2001
CN 1712733 A 12/2005
(Continued)

OTHER PUBLICATIONS

Extended European Search Report for European Application No. 18923649.0, dated May 21, 2021.
(Continued)

*Primary Examiner* — Woody A Lee, Jr.
*Assistant Examiner* — Behnoush Haghighian
(74) *Attorney, Agent, or Firm* — Birch, Stewart, Kolasch & Birch, LLP

(57) ABSTRACT

A rotor includes: a hub; and a plurality of blades disposed on the hub. Each of the plurality of blades has a suction surface, a pressure surface, a leading edge, a trailing edge, a tip-side edge, and a hub-side edge. The suction surface has a first curved surface portion curved convexly toward the trailing edge such that the trailing edge is inclined to a pressure surface side in a first region which is a partial region, in a blade height direction of the blade, of a region connected to the trailing edge.

7 Claims, 13 Drawing Sheets

(51) Int. Cl.
*F04D 17/10* (2006.01)
*F04D 29/38* (2006.01)

(52) U.S. Cl.
CPC .. *F05D 2240/304* (2013.01); *F05D 2240/306* (2013.01)

(58) Field of Classification Search
CPC ..... F05D 2240/303; F05D 2240/304; F05D 2240/305; F05D 2240/306; F05D 2240/307
See application file for complete search history.

(56) References Cited

U.S. PATENT DOCUMENTS

| | | | | | |
|---|---|---|---|---|---|
| 3,069,072 | A * | 12/1962 | Birmann | F04D 29/284 | 415/163 |
| 3,788,765 | A * | 1/1974 | Rusak | F04D 29/284 | 415/227 |
| 4,227,855 | A * | 10/1980 | Flynn | F01D 5/043 | 415/218.1 |
| 4,243,357 | A * | 1/1981 | Flynn | F01D 5/048 | 415/218.1 |
| 4,543,041 | A * | 9/1985 | French | F04D 29/30 | 416/183 |
| 4,664,593 | A * | 5/1987 | Hayashi | F04D 29/164 | 415/119 |
| 6,648,598 | B2 * | 11/2003 | Mimura | F04D 29/164 | 415/220 |
| 8,308,420 | B2 * | 11/2012 | Yagi | F04D 29/30 | 415/1 |
| 8,956,118 | B2 * | 2/2015 | Wakai | F01D 5/048 | 416/183 |
| 9,541,098 | B2 * | 1/2017 | Duquette | F04D 29/30 | |
| 9,605,686 | B2 * | 3/2017 | Hamada | F04D 29/386 | |
| 9,765,795 | B2 * | 9/2017 | Duong | F04D 29/324 | |
| 9,874,219 | B2 * | 1/2018 | Saito | F04D 29/681 | |
| 10,458,427 | B2 * | 10/2019 | McGill | F04D 29/324 | |
| 10,612,556 | B2 * | 4/2020 | Conrad | H02K 5/24 | |
| 10,760,424 | B2 * | 9/2020 | Duong | F01D 5/145 | |
| 10,801,514 | B2 * | 10/2020 | Cao | F01D 5/048 | |
| 11,002,292 | B2 * | 5/2021 | Nakashima | F04D 29/384 | |
| 2009/0035122 | A1 * | 2/2009 | Yagi | F04D 29/284 | 415/1 |
| 2009/0317227 | A1 | 12/2009 | Grover et al. | | |
| 2013/0266451 | A1 | 10/2013 | Pesteil et al. | | |
| 2015/0003966 | A1 | 1/2015 | Duquette | | |
| 2015/0007815 | A1 * | 1/2015 | Duquette | A61M 16/024 | 128/202.27 |
| 2015/0240645 | A1 * | 8/2015 | Yokose | F01D 5/141 | 416/223 R |
| 2016/0076551 | A1 * | 3/2016 | Saito | F04D 29/245 | 415/206 |
| 2017/0284412 | A1 * | 10/2017 | Jonen | F04D 17/10 | |
| 2019/0048878 | A1 * | 2/2019 | Akimoto | F04D 29/284 | |

FOREIGN PATENT DOCUMENTS

| | | | |
|---|---|---|---|
| CN | 1982653 | A | 6/2007 |
| CN | 103261700 | A | 8/2013 |
| DE | 102008059874 | A1 | 6/2010 |
| EP | 1106836 | A2 | 6/2001 |
| EP | 2 020 509 | A2 | 2/2009 |
| EP | 3009686 | A1 | 4/2016 |
| JP | 2002-21785 | A | 1/2002 |
| JP | 2009-41373 | A | 2/2009 |
| JP | 2013-15101 | A | 1/2013 |
| JP | 2013-181390 | A | 9/2013 |

OTHER PUBLICATIONS

International Preliminary Report on Patentability and Written Opinion of the International Searching Authority for International Application No. PCT/JP2018/023830, dated Dec. 30, 2020, with English translation.
International Search Report for International Application No. PCT/JP2018/023830, dated Sep. 25, 2018.
Chinese Office Action and Search Report for Chinese Application No. 201880092689.1, dated Oct. 8, 2021.

* cited by examiner (a)

(b)

ROTOR AND CENTRIFUGAL COMPRESSOR INCLUDING THE SAME

TECHNICAL FIELD

The present disclosure relates to a rotor and a centrifugal compressor including the rotor.

BACKGROUND

Patent Document 1 discloses a centrifugal compressor in which an operating range is extended to the low flow rate side while ensuring a sufficient structural strength of the impeller. In this centrifugal compressor, the pressure surface of each blade mounted on the impeller has a curved surface portion gently curved such that the center of a trailing edge portion is inclined to the suction surface side.

Citation List

Patent Literature

Patent Document 1: JP2013-15101A

SUMMARY

Problems to be Solved

As a result of intensive studies by the present inventors, it has been found that when the curved surface portion disclosed in Patent Document 1 is formed on the pressure side of the blade, although the operating range can be extended to the low flow rate side while ensuring a sufficient structural strength of the impeller, the pressure ratio is reduced. On the other hand, it has been found that when the curved surface portion is formed on the suction side of the blade, the pressure ratio is improved.

In view of the above, an object of at least one embodiment of the present disclosure is to provide a rotor and a centrifugal compressor including the rotor whereby it is possible to improve the pressure ratio.

Solution to the Problems (1) A rotor according to at least one embodiment of the present invention comprises: a hub; and a plurality of blades disposed on the hub. Each of the plurality of blades has a suction surface, a pressure surface, a leading edge, a trailing edge, a tip-side edge, and a hub-side edge. The suction surface has a first curved surface portion curved convexly toward the trailing edge such that the trailing edge is inclined to a pressure surface side in a first region which is a partial region, in a blade height direction of the blade, of a region connected to the trailing edge.

With the above configuration (1), the flow direction of a fluid flowing along the suction surface from the leading edge to the trailing edge is largely curved along the first curved surface portion, and approximates to the rotational direction of the rotor after passing through the trailing edge. With such a change of the air flow direction, the work of the fluid on the rotor increases, so that the pressure ratio by rotation of the rotor is improved.

(2) In some embodiments, in the above configuration (1), the first curved surface portion is connected to the hub-side edge.

(3) In some embodiments, in the above configuration (2), the first curved surface portion is formed in a region 80% or less of a blade height from the hub-side edge in a direction from the hub-side edge to the tip-side edge.

According to studies by the present inventors, the effect of improving the pressure ratio by forming the first curved surface portion on the suction surface increases as the first curved surface portion is close to the hub-side edge. With the above configurations (2) and (3), since the first curved surface portion is formed in the vicinity of the hub-side edge, it is possible to further improve the pressure ratio improvement effect.

(4) In some embodiments, in any one of the above configurations (1) to (3), the first curved surface portion is configured such that, in a cross-section perpendicular to a meridian plane of the blade, an angle of a tangent line of the first curved surface portion with respect to a chord line which is a straight line connecting the leading edge and the trailing edge increases toward the trailing edge.

With the above configuration (4), the flow direction of a fluid flowing along the suction surface from the leading edge to the trailing edge is further largely curved along the first curved surface portion, and further approximates to the rotational direction of the rotor after passing through the trailing edge. With such a change of the air flow direction, the work of the fluid on the rotor further increases, so that the pressure ratio by rotation of the rotor is further improved.

(5) In some embodiments, in any one of the above configurations (1) to (4), the pressure surface has a second curved surface portion curved convexly toward the trailing edge such that the trailing edge is inclined to a suction surface side in a second region which is a partial region, in the blade height direction of the blade, of a region connected to the trailing edge.

With the above configuration (5), a boundary layer formed by the fluid flowing along the pressure surface contracts at the second curved surface portion, so that the flow along the pressure surface is promoted. Thus, it is possible to improve the compression efficiency by rotation of the rotor.

(6) In some embodiments, in the above configuration (5), the second curved surface portion is connected to the tip-side edge.

(7) In some embodiments, in the above configuration (6), the second curved surface portion is formed in a region 70% or less of a blade height from the tip-side edge in a direction from the tip-side edge to the hub-side edge.

According to studies by the present inventors, the effect of improving the compression efficiency by rotation of the rotor by forming the second curved surface portion on the pressure surface increases as the second curved surface portion is close to the tip-side edge. With the above configurations (6) and (7), since the second curved surface portion is formed in the vicinity of the tip-side edge, it is possible to further improve the compression efficiency improvement effect.

(8) In some embodiments, in any one of the above configurations (5) to (7), in a cross-section perpendicular to a meridian plane of the blade, an angle of a tangent line of the second curved surface portion at the trailing edge with respect to a chord line which is a straight line connecting the leading edge and the trailing edge is smaller than an angle of a tangent line of the first curved surface portion at the trailing edge with respect to the chord line.

With the above configuration (8), the first curved surface portion is curved more than the second curved surface portion. Accordingly, since a boundary layer range formed in the vicinity of the trailing edge of the blade is reduced by the fluid flowing along the second curved surface portion, the compression efficiency by rotation of the rotor is improved.

(9) In some embodiments, in any one of the above configurations (5) to (8), the trailing edge is linear from the hub-side edge to the tip-side edge.

With the above configuration (9), since the trailing edge is linear from the hub-side edge to the tip-side edge, it is possible to improve the manufacturing efficiency of the blade.

(10) A centrifugal compressor according to at least one embodiment of the present invention comprises: the rotor described in any one of the above (1) to (9).

With the above configuration (10), it is possible to improve the pressure ratio of the centrifugal compressor.

Advantageous Effects

According to at least one embodiment of the present disclosure, the flow direction of a fluid flowing along the suction surface from the leading edge to the trailing edge is largely curved along the first curved surface portion, and approximates to the rotational direction of the rotor after passing through the trailing edge. With such a change of the air flow direction, the work of the fluid on the rotor increases, so that the pressure ratio by rotation of the rotor is improved.

DETAILED DESCRIPTION

Embodiments of the present invention will now be described in detail with reference to the accompanying drawings. However, the scope of the present invention is not limited to the following embodiments. It is intended that dimensions, materials, shapes, relative positions and the like of components described in the embodiments shall be interpreted as illustrative only and not intended to limit the scope of the present invention.

A rotor according to some embodiments of the present disclosure will be described by taking a rotor (impeller) provided in a centrifugal compressor of a turbocharger as an example. However, the centrifugal compressor in the present disclosure is not limited to a centrifugal compressor of a turbocharger, and may be any centrifugal compressor which operates alone. Further, although not described specifically, the rotor of the present disclosure includes a rotor used for a turbine or an axial-flow pump. In the following description, a fluid to be compressed by the compressor is air, but the fluid may be replaced by any other fluid.

First Embodiment

Figure 1:
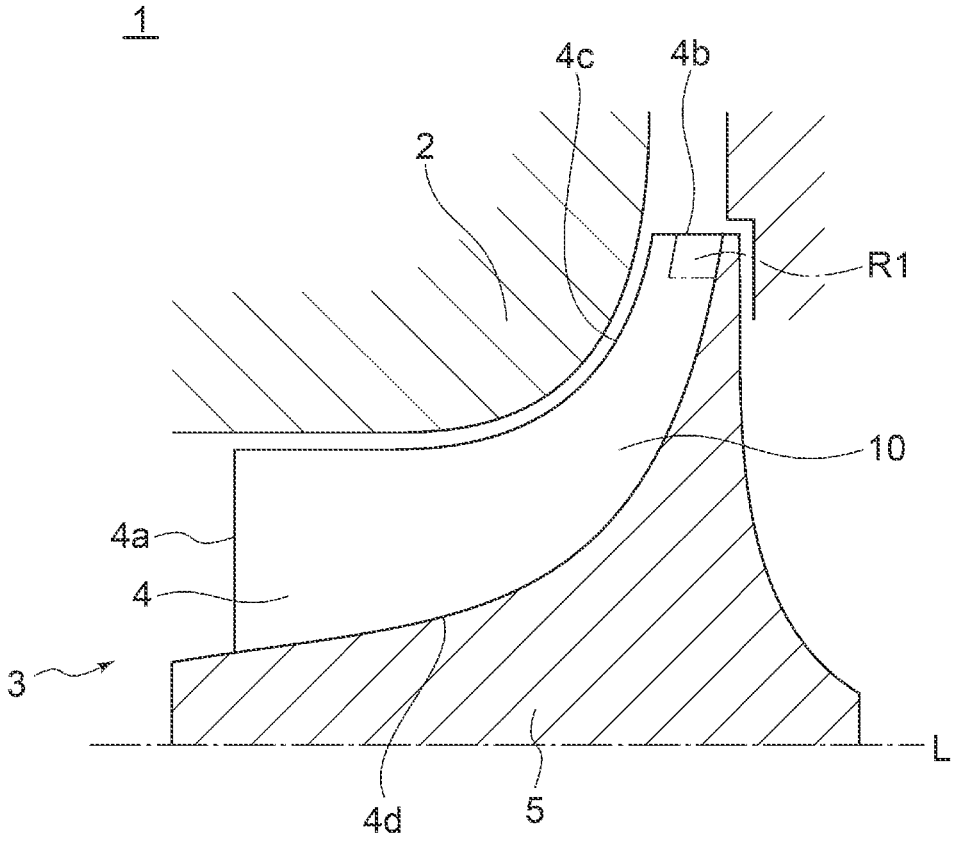
FIG. 1 is a meridional view of a centrifugal compressor including a rotor according to the first embodiment of the present disclosure.

As shown in FIG. 1, the centrifugal compressor 1 includes a housing 2 and an impeller 3 rotatably disposed around the rotational axis L within the housing 2. The impeller 3 has a plurality of blades 4 (only one blade 4 is depicted in FIG. 1) of streamlined shape arranged on the hub 5 at a predetermined interval in the circumferential direction. Each blade 4 includes a leading edge 4*a*, a trailing edge 4*b*, a tip-side edge 4*c* facing the housing 2, and a hub-side edge 4*d* connected to the hub 5.

Figure 2:
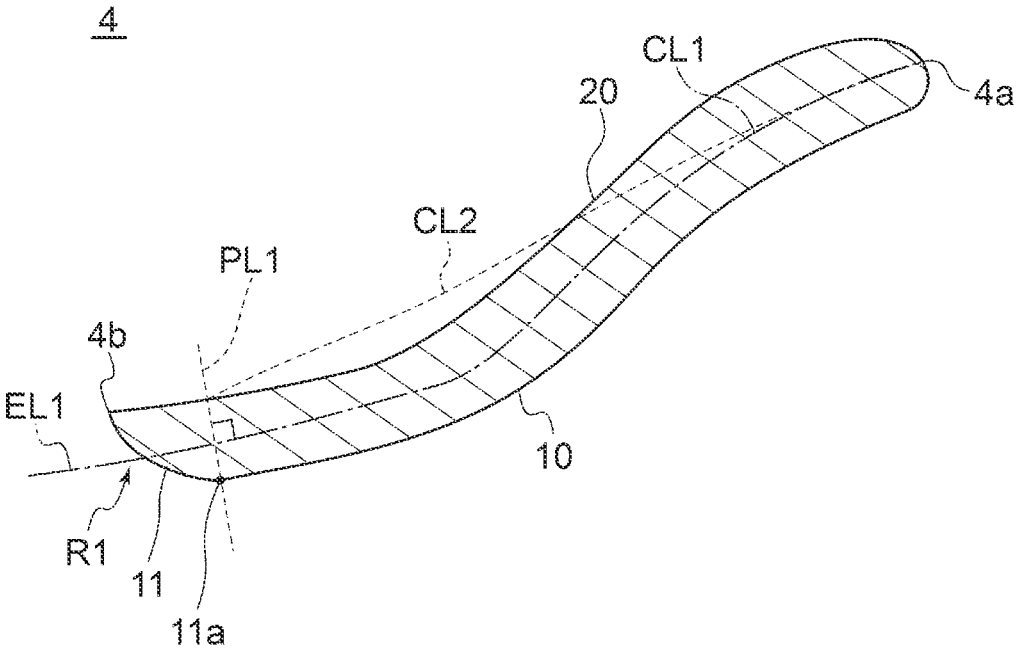
FIG. 2 is a span height cross-sectional view of a blade mounted on a rotor according to the first embodiment of the present disclosure.

A first region R1 is a partial region, in the blade height direction of the blade 4, of a region connected to the trailing edge 4*b* on the suction surface 10 of each blade 4. As shown in FIG. 2, the suction surface 10 of each blade 4 has a first curved surface portion 11 curved convexly toward the trailing edge 4*b* such that the trailing edge 4*b* is inclined to the pressure surface 20 side in the first region R1. In FIG. 2, PL1 is a line that passes through an edge portion 11*a* of the first curved surface portion 11 on the leading edge 4*a* side and is perpendicular to the center line CL1 of the blade 4. EL1 is a line that extends the center line CL1 running from the leading edge 4*a* to the perpendicular line PL1 linearly from the perpendicular line PL1 toward the trailing edge 4*b*. In the first region R1, the trailing edge 4*b* is positioned on a side of the pressure surface 20 with respect to the extension line EL1.

Figure 3:
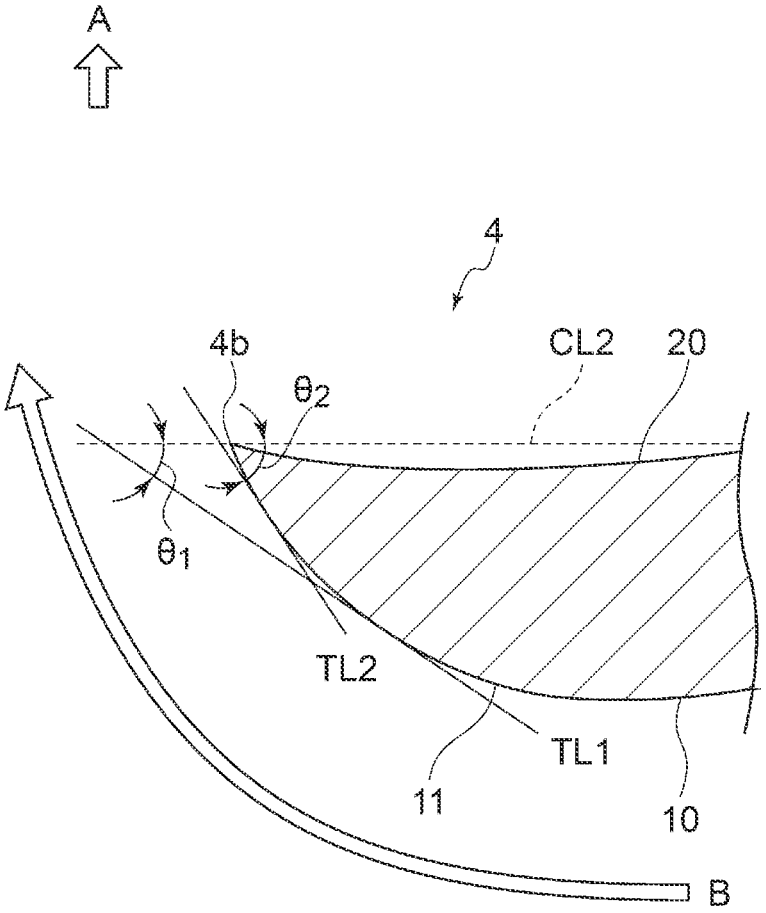
FIG. 3 is a partial cross-sectional view, perpendicular to a meridian plane, in the vicinity of a trailing edge of a blade mounted on a rotor according to the first embodiment of the present disclosure.

As shown in FIG. 3, the convex curve of the first curved surface portion 11 is preferably shaped such that an angle of a tangent line of the first curved surface portion 11 with respect to a chord line CL2 which is a straight line connecting the leading edge 4*a* (see FIG. 2) and the trailing edge 4*b* increases toward the trailing edge 4*b*. In other words, it is preferable that $\theta_1<\theta_2$, where $\theta_1$ is an angle of a tangent line TL1 of the first curved surface portion 11 with respect to the chord line CL2, and $\theta_2$ is an angle of a tangent line TL2 of the first curved surface portion 11 closer to the trailing edge 4*b* than the tangent line TL1 with respect to the chord line CL2.

When the first curved surface portion 11 is present in the first region R1 of the suction surface 10 of each blade 4, the flow direction of the air flowing along the suction surface 10 from the leading edge 4*a* to the trailing edge 4*b* is largely curved along the first curved surface portion 11, and approximates to the rotational direction A of the impeller 3 (see FIG. 1) after passing through the trailing edge 4*b*. With such a change of the air flow direction, the work of the air on the impeller 3 increases, so that the pressure ratio by rotation of the impeller 3, i.e., the pressure ratio of the centrifugal compressor 1 (see FIG. 1) is improved.

Figure 4:
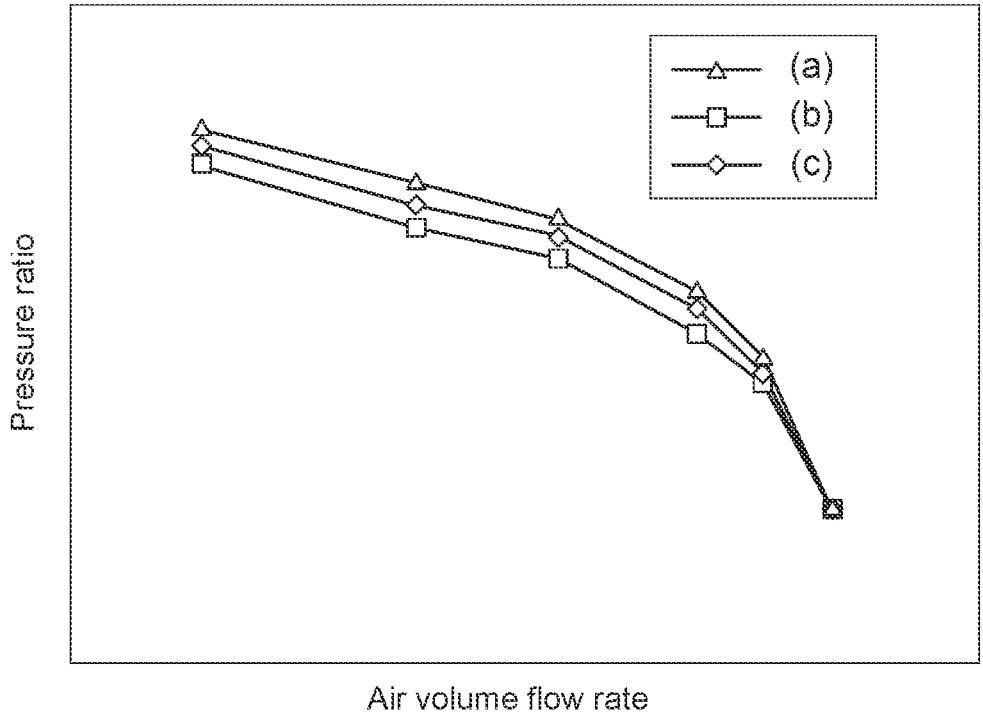
FIG. 4 is a graph showing results regarding a relationship between air volume flow rate and pressure ratio as obtained by CFD analysis.
Figure 4:
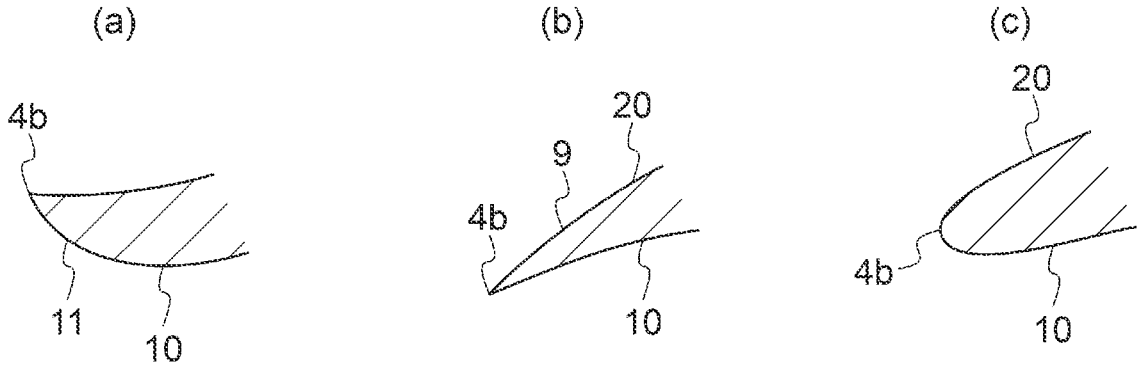

The present inventors confirmed such effect of the first curved surface portion 11 by CFD analysis. The results are shown in FIG. 4. The graph of FIG. 4 shows a relationship between air volume flow rate and pressure ratio as obtained by CFD analysis for a blade according to the first embodiment having the first curved surface portion 11 on the suction surface 10 (depicted in (a)), a blade according to another embodiment having a curved surface portion 9 on the pressure surface 20 as depicted in (b), and a blade according to another embodiment having a substantially elliptical cross-section in the vicinity of the trailing edge 4*b*, as depicted in (c). The relationship indicates that the blade according to the first embodiment having the first curved surface portion 11 on the suction surface 10 has an effect of improving the pressure ratio as compared with the blades according to the other two embodiments.

Figure 5:
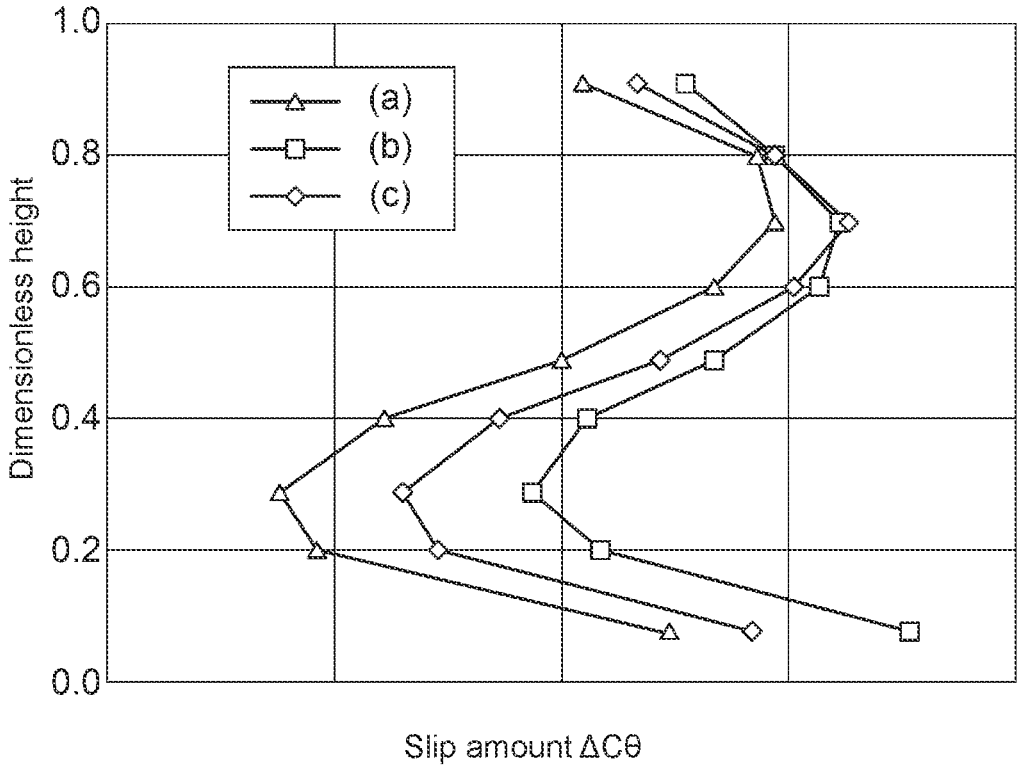
FIG. 5 is a graph showing results regarding a change in slip amount with a change in range of a first region as obtained by CFD analysis.
Figure 5:
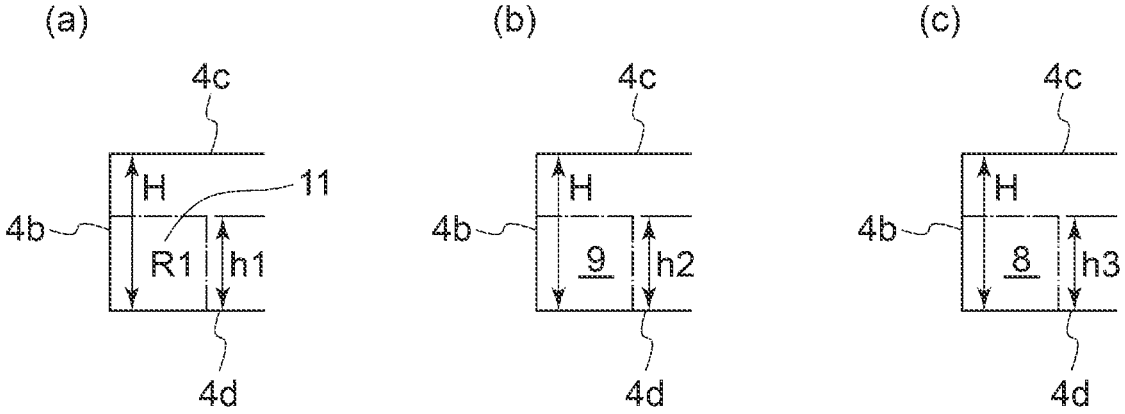

Further, the present inventors confirmed a preferable range of the first region R1 to obtain the pressure ratio improvement effect by CFD analysis. The results are shown in FIG. 5. The graph of FIG. 5 shows a change in slip amount $\Delta C_\theta$ with a change in ratio (span-height) (h1/H) of the height h1 of the first region R1 from the hub-side edge 4*d* to the blade height H in a direction from the hub-side edge 4*d* to the tip-side edge 4*c*, i.e., the dimensionless height of the first region R1, for a blade according to the first embodiment having the first curved surface portion 11 on the suction surface 10 (depicted in (a)). Here, the slip amount $\Delta C_\theta$ is an index of the pressure ratio. In comparison of (a) to (c) of FIG. 5, as the slip amount $\Delta C_\theta$ decreases, the pressure ratio increases.

The graph of FIG. 5 also shows a change in slip amount $\Delta C_\theta$ with a change in ratio (h2/H) of the height h2 of the curved surface portion 9 from the hub-side edge 4*d* to the blade height H in a direction from the hub-side edge 4*d* to the tip-side edge 4*c*, for a blade having the curved surface portion 9 on the pressure surface 20 as shown in (b), and a change in slip amount $\Delta C_\theta$ with a change in ratio (h3/H) of the height h3 of a portion 8 having a substantially elliptical cross-section from the hub-side edge 4*d* to the blade height H in a direction from the hub-side edge 4*d* to the tip-side edge 4*c*, for a blade according to an embodiment having the substantially elliptical cross-section in the vicinity of the trailing edge 4*b*, as shown in (c).

According to the graph of FIG. 5, when the dimensionless height of the first region R1 from the hub-side edge 4*d* is 80% or less, the blade (a) has a smaller slip amount, i.e., has a higher pressure ratio than the blades (b) and (c). Thus, when the dimensionless height of the first region R1 from the hub-side edge 4*d* is 80% or less, preferably 70% or less, more preferably 50% or less, the pressure ratio improvement effect is achieved.

Second Embodiment

Next, the rotor according to the second embodiment will be described. The rotor according to the second embodiment is different from the first embodiment in that the curved surface portion is further formed on the pressure surface 20. In the second embodiment, the same constituent elements as those in the first embodiment are associated with the same reference numerals and not described again in detail.

Figure 6:
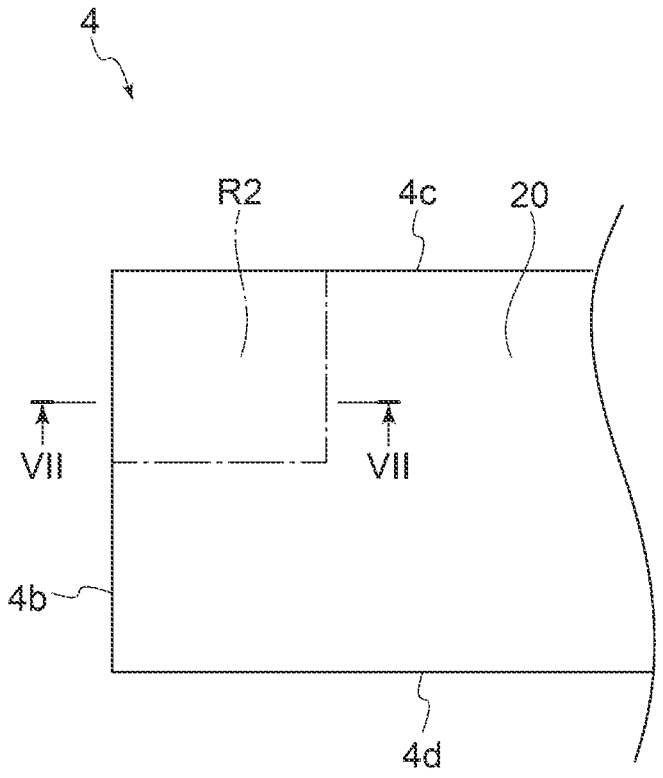
FIG. 6 is a meridional view of the pressure side in the vicinity of a trailing edge of a blade mounted on a rotor according to the second embodiment of the present disclosure.
Figure 7:
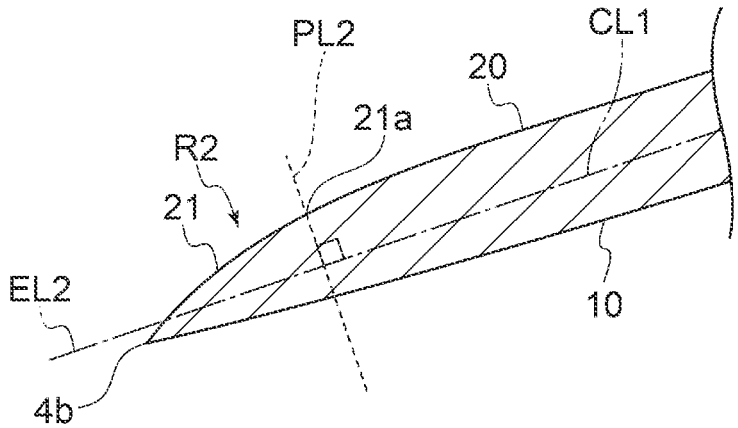
FIG. 7 is a cross-sectional view taken along line VII-VII in FIG. 6.

As shown in FIG. 6, a second region R2 is a partial region, in the blade height direction of the blade 4, of a region connected to the trailing edge 4*b* on the pressure surface 20 of each blade 4. As shown in FIG. 7, the pressure surface 20 of each blade 4 has a second curved surface portion 21 curved convexly toward the trailing edge 4*b* such that the trailing edge 4*b* is inclined to the suction surface 10 side in the second region R2. In FIG. 7, PL2 is a line that passes through an edge portion 21*a* of the second curved surface portion 21 on the leading edge 4*a* side and is perpendicular to the center line CL1 of the blade 4. EL2 is a line that extends the center line CL1 running from the leading edge 4*a* to the perpendicular line PL2 linearly from the perpendicular line PL2 toward the trailing edge 4*b*. In the second region R2, the trailing edge 4*b* is positioned on a side of the suction surface 10 with respect to the extension line EL2.

Figure 8:
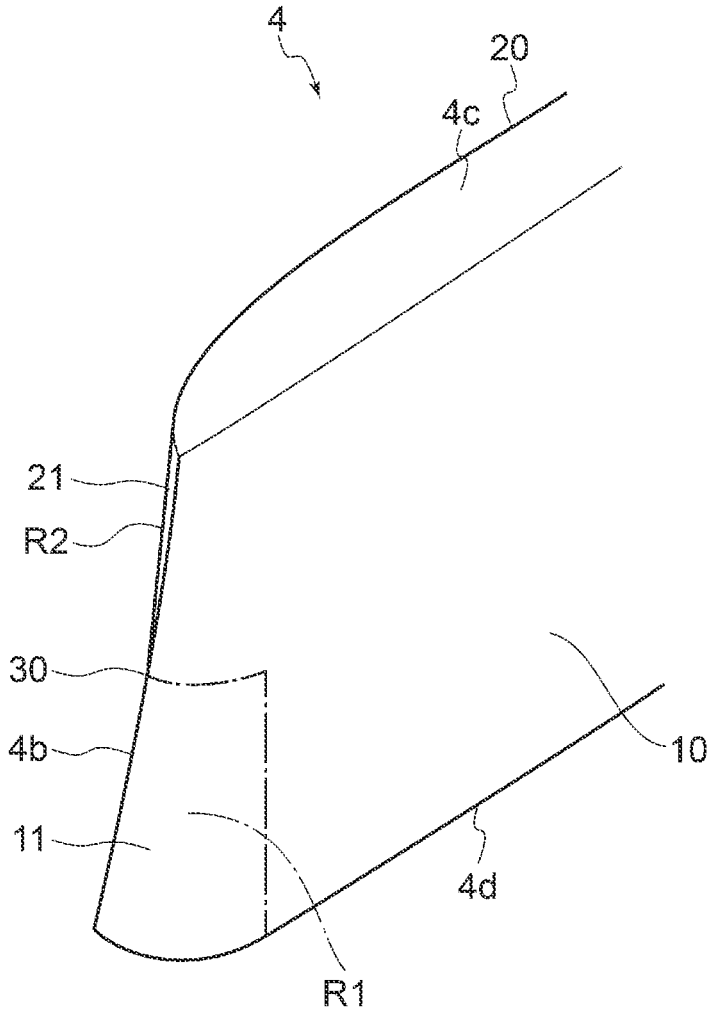
FIG. 8 is a perspective view in the vicinity of a trailing edge of a blade mounted on a rotor according to the second embodiment of the present disclosure.

As shown in FIG. 8, the first region R1 is formed on the suction surface 10 so as to extend from the hub-side edge 4*d* to the tip-side edge 4*c* in the blade height direction, and the second region R2 is formed on the pressure surface 20 so as to extend from the tip-side edge 4*c* to the hub-side edge 4*d* in the blade height direction. As curved surface portions curved convexly toward the suction surface 10 side and the pressure surface 20 side are formed between the first region R1 and the second region R2 in the blade height direction of the blade 4, a middle portion 30 having a substantially elliptical cross-section is formed. When the blade 4 is viewed from a direction facing the trailing edge 4*b*, the trailing edge 4*b* has a linear shape from the hub-side edge 4*d* to the tip-side edge 4*c*. The configuration is otherwise the same as that of the first embodiment.

Figure 9:
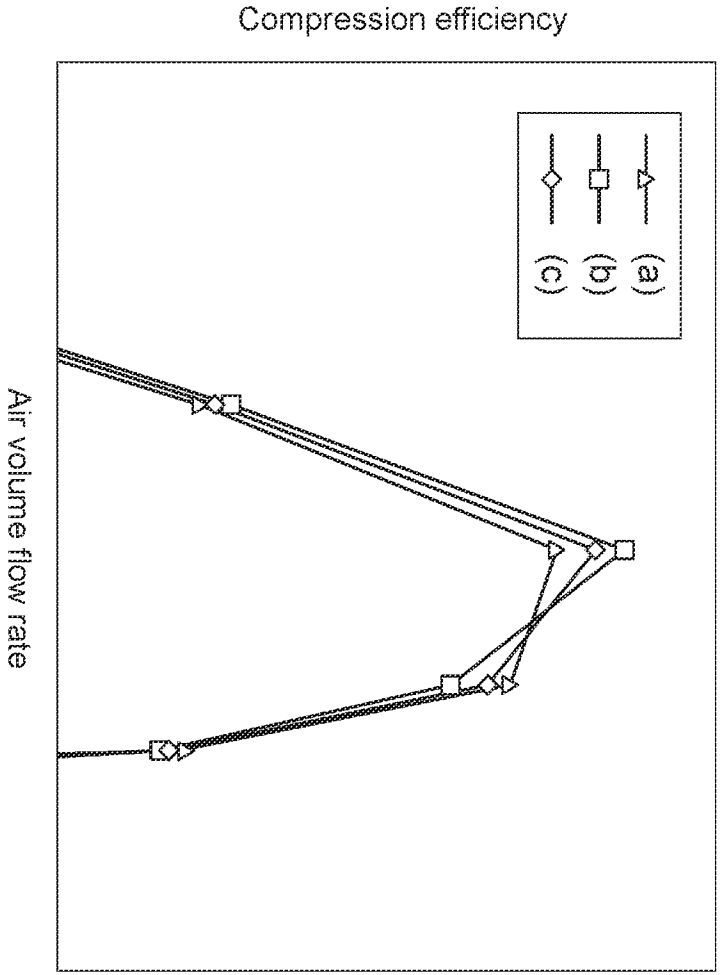
FIG. 9 is a graph showing results regarding a relationship between air volume flow rate and compression efficiency as obtained by CFD analysis.

According to CFD analysis by the present inventors, as described in the first embodiment, the formation of the first curved surface portion 11 on the suction surface 10 improves the pressure ratio of the centrifugal compressor (see FIG. 1) (see FIG. 4). However, as a result of CFD analysis performed by the present inventors on the blades (a) to (c) of FIG. 4, as shown in FIG. 9, it was confirmed the compression efficiency by rotation of the impeller 3 (see FIG. 1), i.e., the compression efficiency of the centrifugal compressor 1 may be reduced in the blade (a) as compared with the other two types of blades, depending on the air volume flow rate. On the other hand, it was confirmed that the compression efficiency of the centrifugal compressor 1 may be maximum in the blade (b) having the curved surface on the pressure surface, depending on the air volume flow rate. This indicates that the compression efficiency of the centrifugal compressor 1 can be improved by further forming the curved surface portion on the pressure surface 20.

Figure 10:
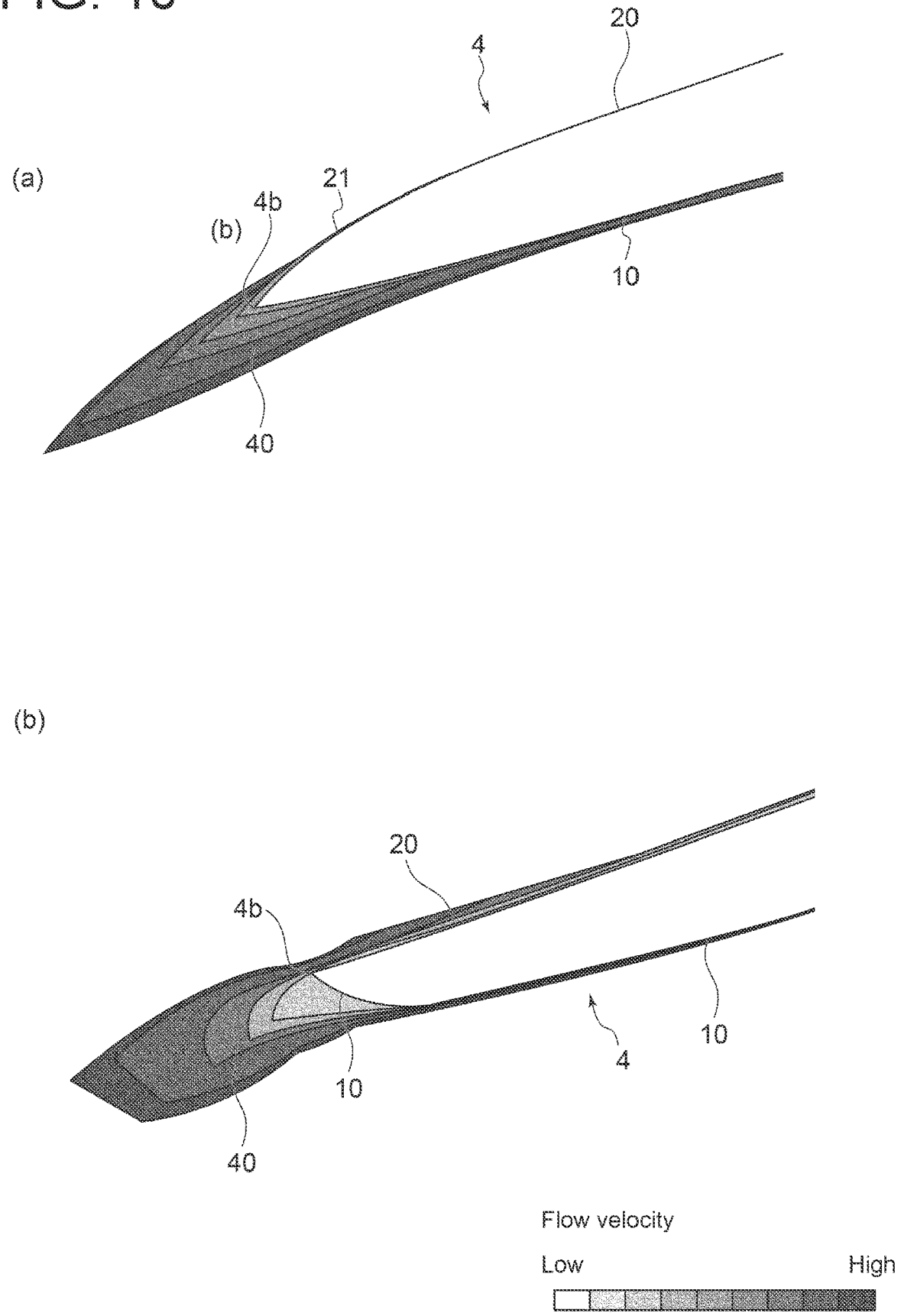
FIG. 10 is a diagram showing results regarding flow velocity distribution in a boundary layer formed on the suction surface and the pressure surface of the blade (b) of FIG. 4 as obtained by CFD analysis.

Part (a) of FIG. 10 shows a flow velocity distribution in the vicinity of a boundary layer formed on the suction surface 10 and the pressure surface 20 of the blade, as obtained by CFD analysis on the blade (b) of FIG. 4. Part (b) of FIG. 10 shows a flow velocity distribution in the vicinity of a boundary layer formed on the suction surface 10 and the pressure surface 20 of the blade, as obtained by CFD analysis on the blade (a) of FIG. 4. As shown in part (a) of FIG. 10, when the second curved surface portion 21 is present in the second region R2 of the pressure surface 20 of each blade 4, a boundary layer 40 formed by flow along the pressure surface 20 from the leading edge 4*a* (see FIG. 1) to the trailing edge 4*b* contracts at the second curved surface portion 21, so that the flow along the pressure surface 20 is promoted. On the other hands, as shown part (b) of FIG. 10, even when the first curved surface portion 11 is present in the first region R1 on the suction surface 10 of each blade 4, the boundary layer 40 does not contract at the first curved surface portion 11. Thus, when the curved surface portion (second curved surface portion 21) is formed on the pressure surface 20, the compression efficiency of the centrifugal compressor 1 is improved.

As shown in FIG. 8, in the blade 4 according to the second embodiment, since the first curved surface portion 11 is formed in the first region R1 connected to the trailing edge 4*b* on the suction surface 10, and the second curved surface portion 21 is formed in the second region R2 connected to the trailing edge 4*b* on the pressure surface 20, it is possible to improve the pressure ratio of the centrifugal compressor 1 (see FIG. 1) as with the first embodiment, and further improve the compression efficiency of the centrifugal compressor 1.

Figure 11:
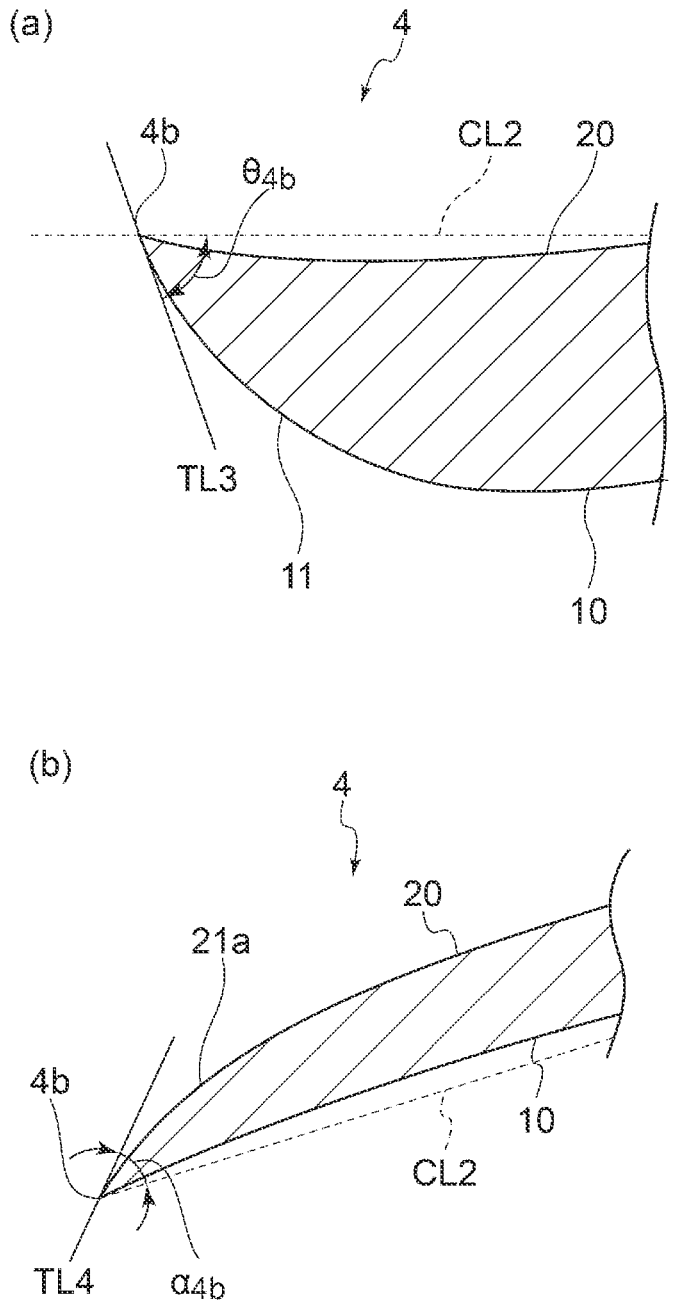
FIG. 11 is a partial cross-sectional view showing the curved shape of each of a first curved surface portion and a second curved surface portion of a rotor according to the second embodiment of the present disclosure.

As shown in part (a) of FIG. 11, in a cross-section perpendicular to a meridian plane of the blade 4, $\theta_{4b}$ is an angle of a tangent line TL3 of the first curved surface portion 11 at the trailing edge 4*b* with respect to the chord line CL2. As shown in part (b) of FIG. 11, in a cross-section perpendicular to a meridian plane of the blade 4, $\alpha_{4b}$ is an angle of a tangent line TL4 of the second curved surface portion 21 at the trailing edge 4*b* with respect to the chord line CL2. In this case, the convex curve of the second curved surface portion 21 preferably satisfies $\alpha_{4b}<\theta_{4b}$. With this configuration, since the boundary layer range formed in the vicinity of the trailing edge 4*b* of the blade is reduced by the air flowing along the first curved surface portion 11 rather than the pressing force of the air flowing along the second curved surface portion 21, the compression efficiency of the impeller 3 is improved.

Figure 12:
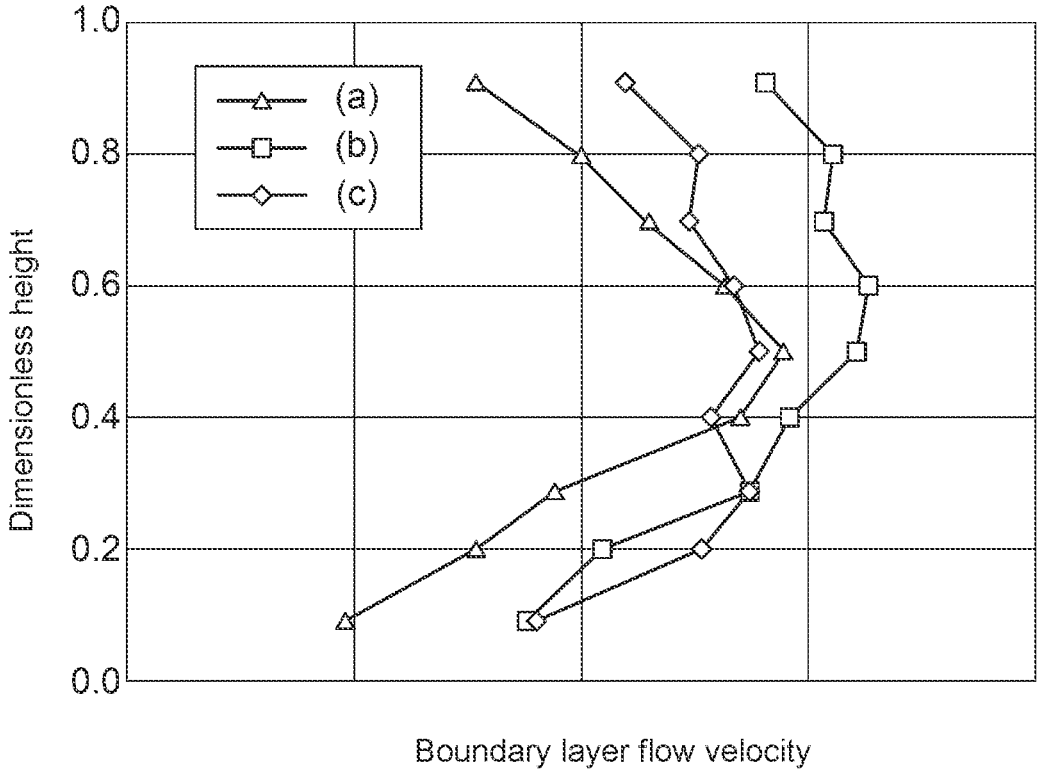
FIG. 12 is a graph showing results regarding a change in boundary layer flow velocity with a change in range of a second region as obtained by CFD analysis.

The present inventors confirmed a preferable range of the second region R2 to obtain the convex curve improvement effect by CFD analysis. The results are shown in FIG. 12. The graph of FIG. 12 shows a change in flow velocity of the air in the boundary layer (boundary layer flow velocity) with a change in dimensionless height of the second region R2 for the blade (b) of FIG. 4. The graph of FIG. 12 also shows a change in boundary layer flow velocity with a change in dimensionless height of the first region R1 for the blade (a) of FIG. 4, and a change in boundary layer flow velocity with a change in dimensionless height of the portion 8 having a substantially elliptical cross-section for the blade (c) of FIG. 4.

According to the graph of FIG. 12, when the dimensionless height of the second region R2 from the tip-side edge 4*c* is 70% or less, the blade (b) has a higher boundary layer flow velocity than the blades (a) and (c). Thus, when the dimensionless height of the second region R2 from the tip-side edge 4*c* is 70% or less, preferably 40% or less, more preferably 30% or less, the compression efficiency improvement effect is achieved.

Figure 13:
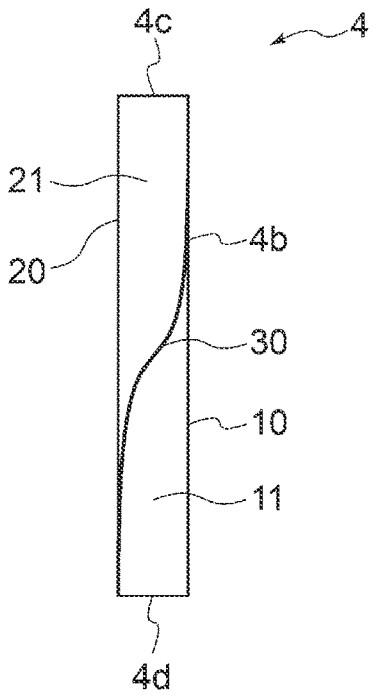
FIG. 13 is a front view in the vicinity of a trailing edge of a modified example of a blade mounted on a rotor according to the second embodiment of the present disclosure.
Figure 13:
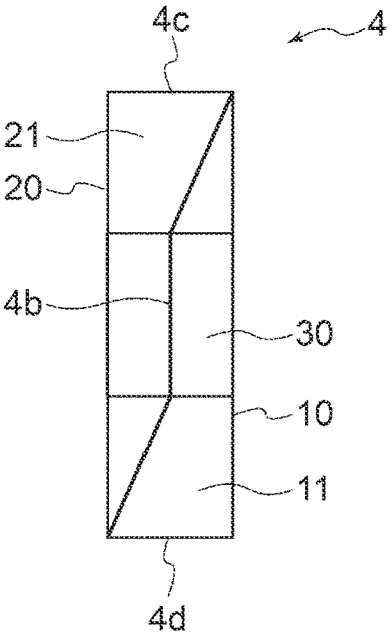

In the second embodiment, as shown in FIG. 8, when the blade 4 is viewed from a direction facing the trailing edge 4*b*, the trailing edge 4*b* has a linear shape from the hub-side edge 4*d* to the tip-side edge 4*c*. However, the present invention is not limited to this embodiment. For example as shown in part (a) of FIG. 13, the trailing edge 4*b* may be curved from the hub-side edge 4*d* to the tip-side edge 4*c*, or for example as shown in part (b) of FIG. 13, the thickness of the middle portion 30 in the blade height direction may be increased so that the trailing edge 4*b* have three linear portions. However, as shown in FIG. 8, when the trailing edge 4*b* is linear from the hub-side edge 4*d* to the tip-side edge 4*c*, it is possible to improve the manufacturing efficiency of the blade 4.

Although in the first and second embodiments, the blade 4 is a full blade, the blade is not limited thereto. The blade 4 may be a splitter blade disposed between two full blades.

REFERENCE SIGNS LIST

1 Centrifugal compressor
2 Housing
3 Impeller (Rotor)
4 Blade
4*a* Leading edge
4*b* Trailing edge
4*c* Tip-side edge
4*d* Hub-side edge
5 Hub
8 Portion having substantially elliptical cross-section
9 Curved surface portion
10 Suction surface
11 First curved surface portion
11*a* Edge portion (of first curved surface portion)
20 Pressure surface
21 Second curved surface portion
30 Middle portion
40 Boundary layer
CL1 Center line
CL2 Chord line
EL1 Extension line
EL2 Extension line
L Rotational axis
PL1 Perpendicular line
PL2 Perpendicular line
R1 First region
R2 Second region
TL1 Tangent line
TL2 Tangent line
TL3 Tangent line
TL4 Tangent line

The invention claimed is:

1. A rotor, comprising:

a hub; and a plurality of blades disposed on the hub, wherein each of the plurality of blades has a suction surface, a pressure surface, a leading edge, a trailing edge, a tip-side edge, and a hub-side edge, wherein the suction surface has a first curved surface portion curved convexly in a first region, which includes a part of the trailing edge and is formed on the suction surface and extends from the hub-side edge toward the tip-side edge, wherein a first perpendicular line is a line that passes through a first edge portion of the first curved surface portion opposite to the trailing edge and is perpendicular to a center line of the blade, a first extension line is a line that extends the center line, which runs from the leading edge to the first perpendicular line, from the first perpendicular line, and in the first region, the trailing edge is positioned opposite to the first edge portion with respect to the first extension line, wherein the first curved surface portion is connected to the hub-side edge, and wherein the first curved surface portion is formed in a region 80% or less of a blade height from the hub-side edge in a direction from the hub-side edge to the tip-side edge.

2. The rotor according to claim 1, wherein the first curved surface portion is configured such that, in a cross-section perpendicular to a meridian plane of the blade, an angle of a tangent line of the first curved surface portion with respect to a chord line which is a straight line connecting the leading edge and the trailing edge increases toward the trailing edge.

3. A rotor comprising:

a hub; and a plurality of blades disposed on the hub, wherein each of the plurality of blades has a suction surface, a pressure surface, a leading edge, a trailing edge, a tip-side edge, and a hub-side edge, wherein the suction surface has a first curved surface portion curved convexly in a first region which includes a part of the trailing edge and is formed on the suction surface so as to extend from the hub-side edge toward the tip-side edge, wherein a first perpendicular line is a line that passes through a first edge portion of the first curved surface portion opposite to the trailing edge and is perpendicular to a center line of the blade, a first extension line is a line that extends the center line which runs from the leading edge to the first perpendicular line from the first perpendicular line, and in the first region, the trailing edge is positioned opposite to the first edge portion with respect to the first extension line, wherein the first curved surface portion is connected to the hub-side edge, wherein the pressure surface has a second curved surface portion curved convexly in a second region, which includes a part of the trailing edge and is formed on the pressure surface and extends from the tip-side edge toward the hug-side edge, wherein a second perpendicular line is a line that passes through a second edge portion of the second curved surface portion opposite to the trailing edge and is perpendicular to the center line, a second extension line is a line that extends the center line, which runs from the leading edge to the second perpendicular line, from the second perpendicular line, and in the second region, the trailing edge is positioned opposite to the second edge portion with respect to the second extension line, wherein the second curved surface portion is connected to the tip-side edge, and wherein the second curved surface portion is formed in a region 70% or less of a blade height from the tip-side edge in a direction from the tip-side edge to the hub-side edge.

4. The rotor according to claim 3, wherein, in a cross-section perpendicular to a meridian plane of the blade, an angle of a tangent line of the second curved surface portion at the trailing edge with respect to a chord line which is a straight line connecting the leading edge and the trailing edge is smaller than an angle of a tangent line of the first curved surface portion at the trailing edge with respect to the chord line.

5. The rotor according to claim 3, wherein the trailing edge is linear from the hub-side edge to the tip-side edge.

6. A centrifugal compressor, comprising the rotor according to claim 1.

7. A centrifugal compressor, comprising the rotor according to claim 3.

* * * * *